United States Patent [19]

Giacomo

[11] 4,316,443

[45] Feb. 23, 1982

[54] BOW STRING RELEASE AID

[76] Inventor: Pack Giacomo, Box 584, Krebbs, Okla. 74554

[21] Appl. No.: 162,447

[22] Filed: Jun. 24, 1980

[51] Int. Cl.[3] ..... F41B 5/00

[52] U.S. Cl. ..... 124/35 A

[58] Field of Search ..... 124/35 A, 41 A, 86, 124/90, 24 R

[56] References Cited

U.S. PATENT DOCUMENTS

| | | | |
|---|---|---|---|
| 3,952,720 | 4/1976 | Wilson | 124/35 A |
| 3,998,202 | 12/1976 | Boyko | 124/35 A |
| 4,009,703 | 3/1977 | Cunningham | 124/35 A |
| 4,105,011 | 7/1978 | Chism | 124/35 A |
| 4,173,210 | 11/1979 | Napier | 124/35 A |

*Primary Examiner*—Richard C. Pinkham
*Assistant Examiner*—William R. Browne
*Attorney, Agent, or Firm*—Cushman, Darby & Cushman

[57] ABSTRACT

A trigger device for facilitating pulling bow strings and for quick release of the taut bow string and arrow, the quick release being actuated by either one or both of two mechanical links to a latch mechanism. The links are respectively actuable by the application of pressure by either or both of the archers thumb or small finger to a corresponding slide member housed in passages of a T-shaped passageway within a T-shaped housing. The housing is contoured for gripping by a hand. The slide members are each linked to a pivotable member which is engaged with the latch for the opening thereof.

10 Claims, 3 Drawing Figures

BOW STRING RELEASE AID

BACKGROUND OF THE INVENTION

The invention relates to bow string release devices and more particularly to a release device which may be actuated by either or both of two fingers of one hand of the archer.

In response to the desire for greater accuracy and ease in the shooting of a bow and arrow, various devices have been developed which allow the archer to pull back on the string with the entire grip of the hand without being required to exert any extra force with the ends of the fingers. Such devices are disclosed in U.S. Pat. No. 4,006,060 issued to Napier, U.S. Pat. No. 4,004,564 issued to Castonguay, U.S. Pat. No. 3,954,095 issued to Lewis, U.S. Pat. No. 3,952,720 issued to Wilson, U.S. Pat. No. 3,898,974 issued to Keck, and U.S. Pat. No. 3,757,763 issued to Pinti et al. With each of these devices, a trigger is provided which can be actuated with a single given finger of the archer's hand as he pulls back on the bow string. Which finger may be used for triggering depends on the design of the particular release device. The release of the bow string and arrow is a very sensitive and exacting step in the shooting process, and different archers have different preferences in this regard depending on their particular shooting styles. Accordingly, different release devices have been designed for triggering by different fingers. For example, Napier and Wilson provide for small finger release, and Castonguay and Keck provide for thumb release. Pinti discloses a forefinger release. The devices, however, provide the archer with no flexibility in this regard. They do not allow triggering by a second finger or by two fingers as the same or two different archers may alternately prefer.

SUMMARY OF THE INVENTION

The present invention overcomes the above-described disadvantage of prior bow string release devices by providing an improved bow string release device which includes two release actuation mechanisms which may be operated individually or together by the archer's thumb and little finger. By providing two such mechanisms, an archer may learn to overcome the bad habit of "flinching" prior to bow string release. Such flinching may manifest itself in easily detected premature release of the bow string by actuation of one release mechanism before the archer's desired actuation of the other release mechanism.

In the preferred embodiment of the invention, the device includes a generally T-shaped housing formed of a central arm and two-sided arms contoured for gripping by an archer's hand. The housing has a generally T-shaped passagway having open ends. A latch is provided in a recess formed at the open end of the central leg of the housing for engaging and releasing the bow string using a rope or other elongated flexible member which is secured to the housing. The rope may be wrapped around the bow string and is received in the recess by the latch, thus securing the bow string to the device. An elongated lever is mounted to the housing in the passageway of the central leg of the housing for selectively opening the latch. The elongated lever is alternately moved to open the latch by either or both of two mechanical links respectively disposed in the passageway of the two side arms of the housing. One of the two mechanical links is an elongated member which may slide longitudinally inward to push at its inner end against one side of the elongated lever. The other mechanical link includes an elongated slide member and a lever arranged to push against the one side of the elongated lever when the elongated member is pushed inward, thus permitting the latch to be opened by operation of either mechanical link or both mechanical links operating together. The rope is arranged to snap out of the recess and away from the archer's face, releasing the taut bow string when the latch is opened.

In accordance with another advantageous feature of the invention, the two mechanical links are mounted to the housing so that either may easily be temporarily or permanently removed from the device without affecting the operability of the other mechanical link.

BRIEF DESCRIPTION OF THE DRAWINGS

These and other aspects of the invention will be better understood from the following detailed description of the preferred embodiment when read in conjunction with the appended drawings in which.

DETAILED DESCRIPTION OF THE PREFERRED EMBODIMENT

Figure 1:
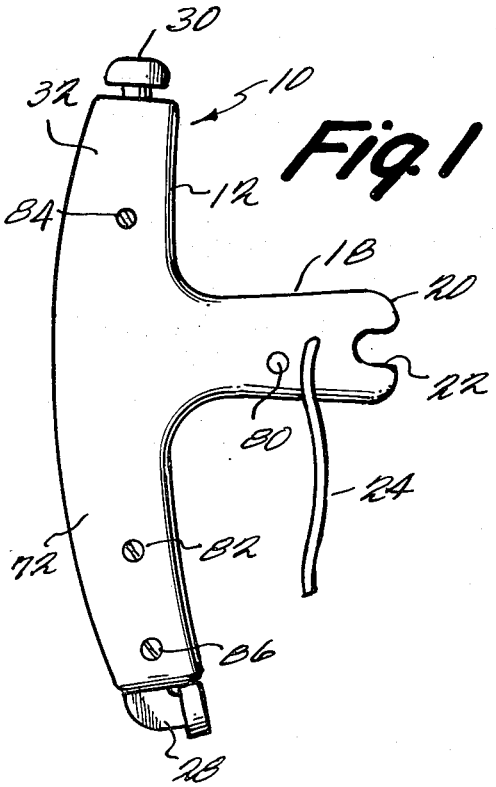
FIG. 1 is a front elevation of the proposed string release device of the present invention.

Referring first to FIG. 1, the overall string release device of the present invention identified by the numeral 10, includes a substantially T-shaped housing 12 comprising two side arms 14 and 16 and a central arm 18. The arms 14, 16 and 18 are contoured for gripping by a hand substantially as shown in the FIG. 2. The open end 20 of central arm 18 includes a recess 22 for receiving thereacross a flexible elongated member such as rope 24 which is fastened to housing 12. Rope 24 may be wrapped around the bow string and is releasably held in recess 22 by latch 26 which is pivotably mounted to arm 18 as is best illustrated in FIG. 3. Latch 26 is semicircular in shape so that its upper end 46 may cross recess 22 to lock rope 24 therein and so that its lower end 48 may be engaged by a mechanical linkage system as will be described.

Figure 2:
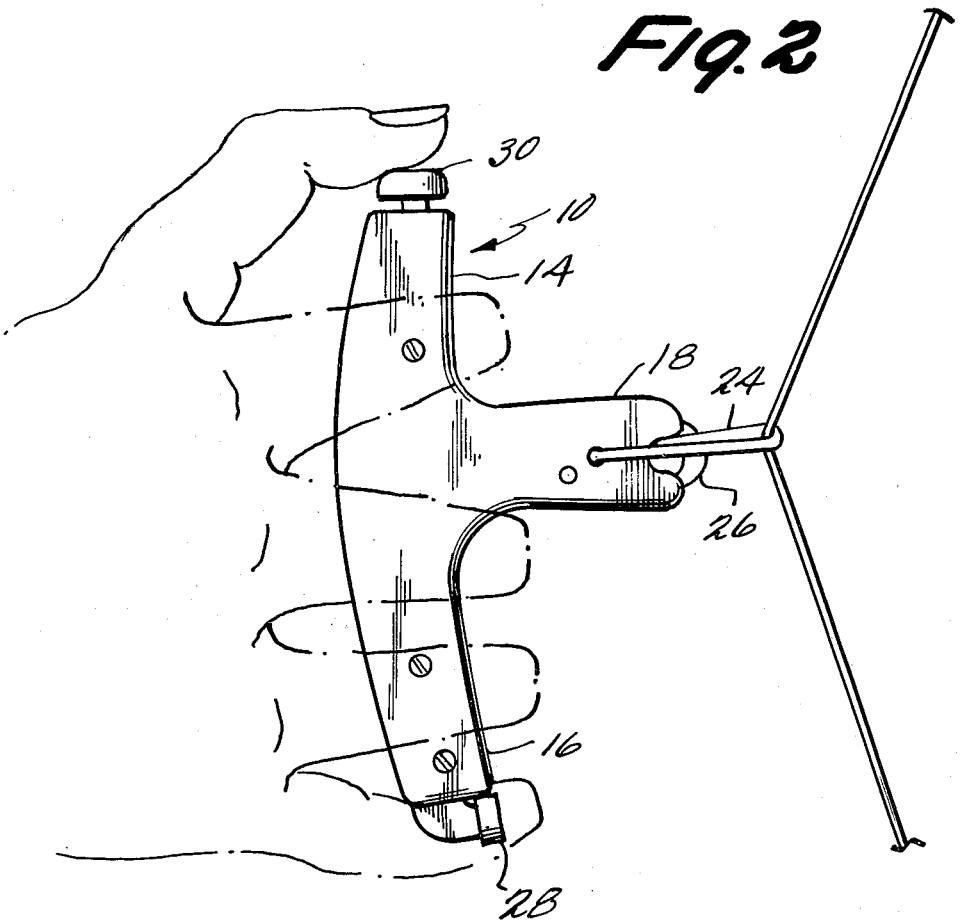
FIG. 2 is a view of the present invention held by the hand of an archer pulling back on a bow string.
Figure 3:
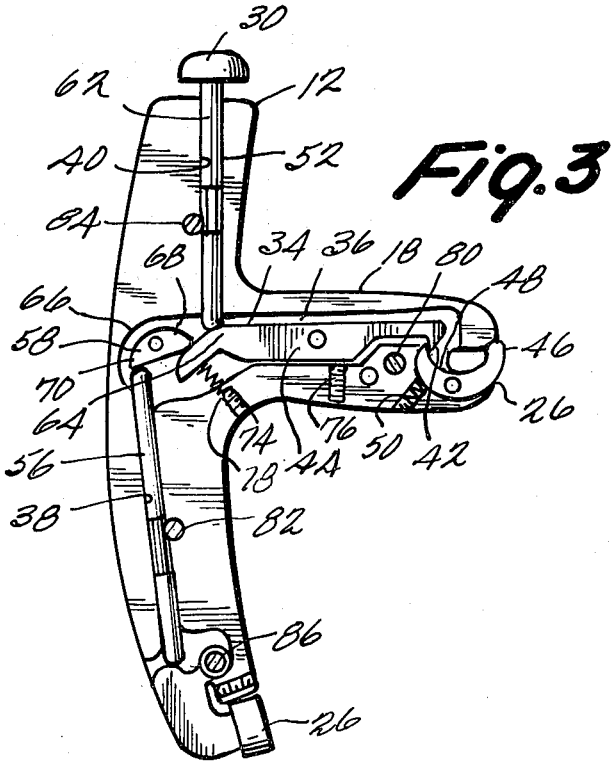
FIG. 3 is a front view of the invention with the top cover removed.

The opening of latch 26 is alternately actuated by the archer's thumb or small (pinky) finger through mechanical links, the actuators of which, 28 and 30, are respectively shown in FIG. 1 and FIG. 2. The mechanical links are disposed below housing cover 32 which has been removed in the view shown in FIG. 3. Referring to FIG. 3, housing 12 has formed therein a generally T-shaped passageway 34 in which is housed the mechanical linkage system for releasing the latch 26. The T-shaped passageway 34 includes a central arm passage 36, and small finger and thumb arm passages 38 and 40. Latch 26 is held in closed position by a lip end portion 42 of an elongated lever 44 which is pivotably mounted in passage 36. Latch 26 is semicircular in shape and is pivotably mounted centrally to the housing. The upper portion 46 of latch 26 is arranged so as to be held in a closed position crossing recess 22 when lip portion 42 engages the bottom portion 48 of latch 26 to prevent counterclockwise pivoting of the latch. When lip 42 of lever 44 is disengaged from latch portion 48, central arm 18 latch 26 is free to rotate counterclockwise so that the latch upper portion 46 is disengaged from recess 22 to permit rope 24 to snap outward releasing the bow string. A spring 50 formed in central arm 18 adjacent latch 26 serves to bias latch 26 in an open position when not engaged by lip 42 of lever 44.

The remainder of the mechanical linkage system is composed of a thumb release plunger 52, small finger release lever (actuator) 28, a small finger slide member 56, and a relay lever 58. Thumb release plunger 52 includes thumb contact member (actuator) 30 which is fixed to the outer end of an elongated member 62 which slides in passage 40 so as to engage the lower end 64 of elongated lever 44. Thus, by pushing thumb release plunger 52 inward, elongated lever 44 is caused to rotate clockwise to release latch 26.

Relay lever 58 is pivotably mounted to the housing in a recess 66 beneath the inner end of passage 40. Relay lever 58 has a half disk shape and is so positioned that the upper corner thereof 68 is engageable with the lower end 64 of elongated lever 44 just beneath the inner end of the thumb release elongated member 62. Small finger arm passage 38 opens into the bottom of recess 66 and small finger slide member 56 is slidable therein for engaging the lower corner 70 of relay lever 58. Small finger release lever 28 is pivotably mounted to housing arm 16 above passage 38. The outer end of slide member 56 is engageable by small finger release lever 28 when the latter is depressed by the small finger so as to pivot counterclockwise, thereby pushing slide member 56 against relay lever 58. This causes relay lever 58 to rotate counterclockwise against the lower end 64 of elongated lever 44 to cause lever 44 to release from latch 26 in the same manner as was described above with respect to the operation of thumb release plunger 52.

The pivoting movement of lever 44 is limited by a pair of set screws 74 and 76 respectively extending into passage 36 from housing 12. A spring 78 surrounds set screw 74 and contacts the lower end 64 of elongated lever 44 to bias the same in a counterclockwise direction so as to hold latch 26 in a closed position until open by actuation of one of the release mechanisms. The set screw 74 is an adjustable tension screw which allows varying degrees of tension required to release the device.

Referring again to FIG. 1, cover 72 is removably fastened onto the remainder of body 12 by screws 80, 82, and 84. Another screw 86 pivotably holds the small finger release lever 28 onto arm 16. Screws 82 and 84 are positioned so as to be disposed in grooves 88 and 90 which are formed in elongated slide members 56 and 62. Screws 82 and 84 thereby serve as stop members for limiting the sliding motion of slide members 56 and 62. As is apparent from FIG. 1 and FIG. 3, by temporarily removing screws 82 and 86, small finger release members 28 and 56 may be removed from the device without affecting the operability of thumb release plunger 52. Similarly, by temporarily removing screw 84, thumb release plunger 52 may be removed from the device without affecting the operability of the small finger release components 28 and 56.

In operating the device of the present invention, rope 24 is wrapped about the bow string and inserted in recess 22 which is normally held open by bias spring 50. The latch 26 is then manually closed. The archer then grips the device as is shown in FIG. 2 and pulls back on the bow string. When the archer is ready to shoot, he depresses one or both of lever 28 and thumb release plunger 52, thereby causing lever 44 to rotate in a clockwise direction so that lip 42 disengages latch 26. The outward pressure of the taut bow string against rope 24 aided by bias spring 50 will cause the latch to immediately open, releasing the bow string.

It will be appreciated by those of ordinary skill in the art to which this invention pertains that although only a single exemplary embodiment of the invention has been hereinabove described, there are many modifications which may be made fully within the scope of the invention, limited only by the appended claims.

What is claimed is:

1. A release device for a bow string comprising:

(1) a generally T-shaped housing having a central portion and first and second arm portions respectively extending outwardly from said central portion to first and second free ends, said first and second arm portions being contoured for gripping by a hand, said T-shaped housing having a generally T-shaped passageway extending through said first and second arm portions and said central portion, said central portion having an open end and a recess for receiving a flexible element, said recess communicating with the central portion of said passageway;

(2) latch means, mounted within said housing at said recess for selective engagement with the flexible element, for alternate opening and closing thereof to alternately retain and release the flexible element with respect to said recess;

(3) first mechanical linkage means, including a first part disposed in the first arm portion of said passageway and a second part disposed in said central portion of said passageway, engageable with said latch means and movable between a first position and a second position, for closing said latch means when said first linkage means is in said first position and for opening said latch means when said first linkage means in said second position; and (4) second mechanical linkage means disposed in the second arm portion of said passageway, engageable with and operative through said second part of said first mechanical linkage means and movable between a third position and a fourth position, for opening said latch means when moved from said third position to said fourth position;

said first linkage means including first mechanical means, disposed at said first free end and engageable by one of the group consisting of a finger other than the thumb and the thumb of said hand when said housing is gripped by said hand, for moving said first linkage means from said first position to said second position;

said second linkage means including second mechanical means, disposed at said second free end and engageable by the other of said group when said housing is gripped by said hand, for moving said second linkage means from said third position to said fourth position.

2. Release device as in claim 1 wherein said first mechanical linkage comprises:

(1) an elongated lever pivotably mounted in said central portion of said passageway for pivoting about an axis perpendicular to the length of said central portion to engage and disengage said latch means; and (2) a first elongated member slidable along the length of the first arm portion of said passageway to engage and pivot said elongated lever in a first angular direction.

3. Release device as in claim 2, wherein said second linkage means comprises a second elongated member slidably mounted along the length of said second arm portion of said passageway, and pivotal means, engageable with said second elongated member and said elongated lever and pivotable about an axis perpendicular to the length of said third elongated member, for pivoting said elongated lever in said first angular direction in response to sliding movement of said second elongated member.

4. Release device as in claim 3, further comprising means for spring biasing said first elongated member into engagement with said latch means to hold said latch means in a closed position and means for spring biasing said latch means in an open position so that said latch means is maintained open when disengaged from said elongated lever.

5. A release device for a bow string comprising:

(1) a generally T-shaped housing having a first end, a second end, and a third end, said first and second ends being contoured for gripping by a hand with the thumb of said hand adjacent said first end and a finger of said hand other than said thumb adjacent said second end; said third end defining an open cavity for receiving an elongated flexible element therein;

(2) latch means, mounted to said housing at said recess for selective engagement with said element, for alternate opening and closing thereof to alternately retain and release the flexible element with respect to said recess;

(3) first mechanical linkage means, mounted to said housing, extending from a point between said first and second ends to said third end, engageable with said latch means and movable between a first position and a second position, for retaining said latch means in a closed position when said first linkage means is in said first position and for opening said latch means by movement from said first position to said second position;

(4) second mechanical linkage means, extending from said first end to said point and engageable with said first linkage means, for mechanically moving said first linkage means between said first and second positions;

(5) third mechanical linkage means, extending from said second end to said point and engageable with said first linkage means, for mechanically moving said first linkage means between said first and second positions;

(6) first actuation means, disposed at said first end and engageable by said thumb when said hand is gripping said housing, for actuating said second linkage means to move said first linkage means from said first position to said second position; and (7) second actuation means, disposed at said second end and engageable by said finger when said hand is gripping said housing, for actuating said third linkage means to move said first linkage means from said first position to said second position.

6. A release device as in claim 1 or claim 5 wherein said finger is the small finger of said hand.

7. A release device as in claim 1 or claim 5, wherein the flexible element is a length of rope or the like secured to said housing for selective engagement with a bow string, said latch means extending, transversely across said recess and being selectively engageable therewith for alternate opening and closing thereof to alternately retain and release said rope or the like with respect to said recess.

8. A release device as in claim 5 wherein said housing comprises a generally T-shaped housing including first, second and third arms each having an open ended passage therein for respective receiving said first, second, and third linkage means therein, said first arm passage opening into said recess.

9. A release device as in claim 8 wherein said second linkage means comprises a first elongated member extending the length of said second arm and slidable along said second arm passage, said third linkage means comprises a second elongated member extending the length of said third arm and slidable along said third arm passage, at least one of said first and second elongated members having a groove therein; said housing including at least one removable stop member, slidably engaging said at least one of said first and second elongated members in said groove, said at least one of said first and second elongated members being removable from said second and third arm passages by removing said at least one removable stop.

10. A release device for a bow string comprising (1) a generally T-shaped housing having a central portion and first and second arm portions respectively extending outward from said central portion to first and second free ends, said first and second arm portions being contoured for gripping by a hand;

(2) latch means, mounted to said central portion for selective engagement with a flexible element, for alternate opening and closing thereof to alternately retain and release the flexible element with respect to said central portion;

(3) first means, disposed at said first free end and engageable by the thumb of said hand for mechanically opening said latch means; and (4) second means, disposed at said second free end, and engageable by a finger of said hand other than the thumb, for mechanically opening said latch means.

* * * * *